US005109558A

United States Patent [19]

Di Blasi

[11] Patent Number: 5,109,558

[45] Date of Patent: May 5, 1992

[54] BED WITH ITS RESTING SURFACE AT LEAST PARTLY OF KEYBOARD FORM

[76] Inventor: Rosario Di Blasi, Via Messina 6, 96015 Francofonte, Siracusa, Italy

[21] Appl. No.: 731,124

[22] Filed: Jul. 15, 1991

Related U.S. Application Data

[63] Continuation of Ser. No. 448,759, Dec. 11, 1989, abandoned.

[30] Foreign Application Priority Data

Dec. 23, 1988 [IT] Italy ..... 23086 A/88

[51] Int. Cl.[5] ..... A47C 20/02

[52] U.S. Cl. ..... 5/611; 5/236.1; 5/60; 128/33

[58] Field of Search ..... 5/236.1, 239, 244, 60, 5/446, 447, 238, 241, 65, 253, 431; 128/33

[56] References Cited

U.S. PATENT DOCUMENTS

| | | | |
|---|---|---|---|
| 595,734 | 12/1897 | Rand | 5/446 |
| 736,139 | 8/1903 | Needham | 5/65 |
| 1,328,878 | 6/1920 | Kaplan | 5/238 |
| 2,112.367 | 3/1938 | Hyter | 128/33 |
| 2,672,860 | 3/1954 | Badger | 123/33 |
| 2,906,259 | 9/1959 | Adair | 5/60 |
| 3,298,363 | 1/1967 | Parkin | 5/446 |
| 3,340,548 | 9/1967 | Janapol | 5/60 |
| 4,136,409 | 1/1979 | Ishida | 5/465 |
| 4,494,260 | 1/1985 | Olds | 5/446 |
| 4,799,276 | 1/1989 | Kadish | 5/446 |

FOREIGN PATENT DOCUMENTS

| | | | |
|---|---|---|---|
| 103807 | 9/1983 | European Pat. Off. | 5/236.1 |
| 309493 | 11/1918 | Fed. Rep. of Germany | 5/65 |
| 511050 | 10/1930 | Fed. Rep. of Germany | 5/60 |
| 2832584 | 2/1980 | Fed. Rep. of Germany | 5/200.1 |
| 671049 | 4/1952 | United Kingdom | 5/65 |
| 2178307 | 2/1987 | United Kingdom | 5/447 |

*Primary Examiner*—Renee S. Luebke
*Assistant Examiner*—F. Saether
*Attorney, Agent, or Firm*—Steinberg & Raskin

[57] ABSTRACT

A bed is provided with a frame (2, 102) and a keyboard-shaped resting surface (3, 103) comprising a series of mutually independent transverse adjacent removable elements (5, 105, 205) which are vertically mobile independently of each other. This movement is produced by hydraulic cylinder-piston units, manually or motor-operated articulated parallelogram systems (270), or equivalent systems.

12 Claims, 2 Drawing Sheets

BED WITH ITS RESTING SURFACE AT LEAST PARTLY OF KEYBOARD FORM

This is a continuation of application Ser. No. 07/448,759, filed Dec. 11, 1989, now abandoned.

BACKGROUND OF THE INVENTION

This invention relates to a bed, in particular a bed suitable for use in hospitals, nursing homes and the like, in those cases in which the user is obliged, for illness or other reasons, to remain lying for a considerable time.

It is well known that persons who for medical reasons are obliged to remain in bed for a considerable time are subject to the formation of painful sores (bed sores) caused by prolonged pressure on limited regions of the body.

Various methods are already known for preventing the formation of these sores on patients compelled to remain in bed for a considerable time.

One of these methods comprises placing a mattress below the patient and used an apparatus comprising a double series of flexible tubes arranged to be alternating with each other.

These flexible tubes are formed by gluding two sheets of flexible plastics material to each other in a suitable manner to form a mattress having the thickness of a usual beach bed. The two series of tubes can be alternately inflated and deflated by a suitable electrically driven pump.

This method does not eliminate the problems which arise for a patient during a long period in bed. In this respect the patient is always in contact with the mattress and even the alternate deflating of the two series of flexible tubes does not result in the separation of the patient's body from the mattress, but merely reduces the pressure on that part of the body above the tubes from which the air has been removed.

Furthermore, the tube inflation (or deflation) extends over the entire surface of the mattress and it is not possible to limit this action to a chosen limited region thereof.

SUMMARY OF THE INVENTION

An object of the present invention is therefore to provide a bed, in particular for persons obliged for medical reasons to remain in a lying position for long periods, which prevents the formation of bed sores.

A further object is to provide a bed of the aforesaid type which enables the patient to undergo treatment for regions of his body resting on the bed without his having to leave the bed or be moved from his supine position.

These and further objects which will be more apparent to the expert of the art are attained by a bed of the aforesaid type, characterized by comprising a frame and an at least partly keyboard-shaped resting surface comprising a series of mutually independent transverse adjacent elements which are vertically mobile independently of each other relative to the resting surface, means being provided rigid with the bed frame for generating the movement of said elements.

BRIEF DESCRIPTION OF THE DRAWING

The present invention will be more apparent from the accompanying drawings, which is provided by way of non-limiting example and in which.

DESCRIPTION OF THE PREFERRED EMBODIMENTS

Figure 1:
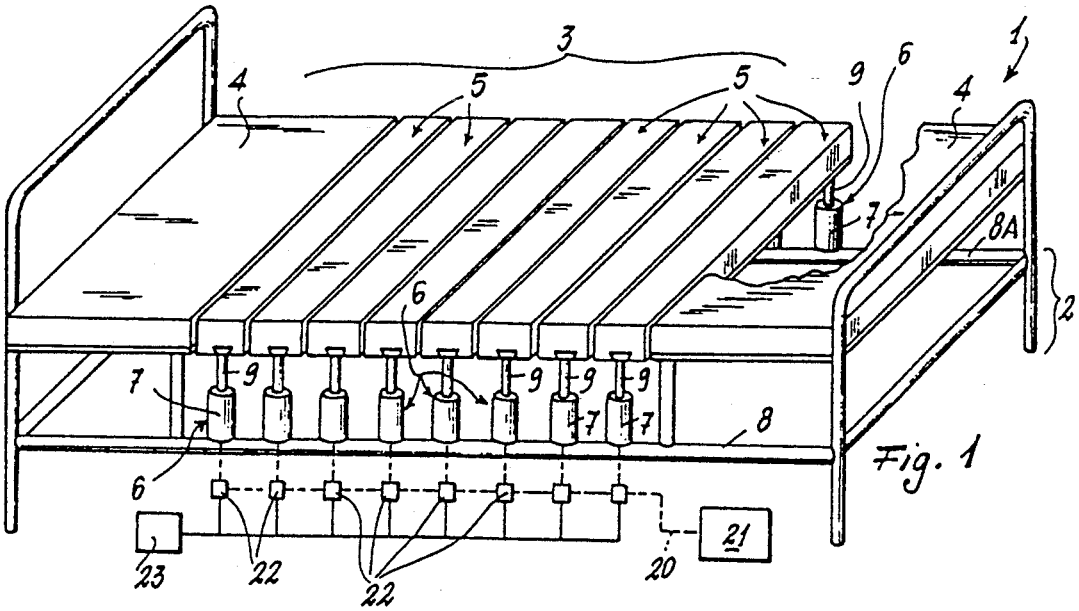
FIG. 1 is a perspective view of the bed according to the invention with a part thereof shown in section for greater clarity.
Figure 2:
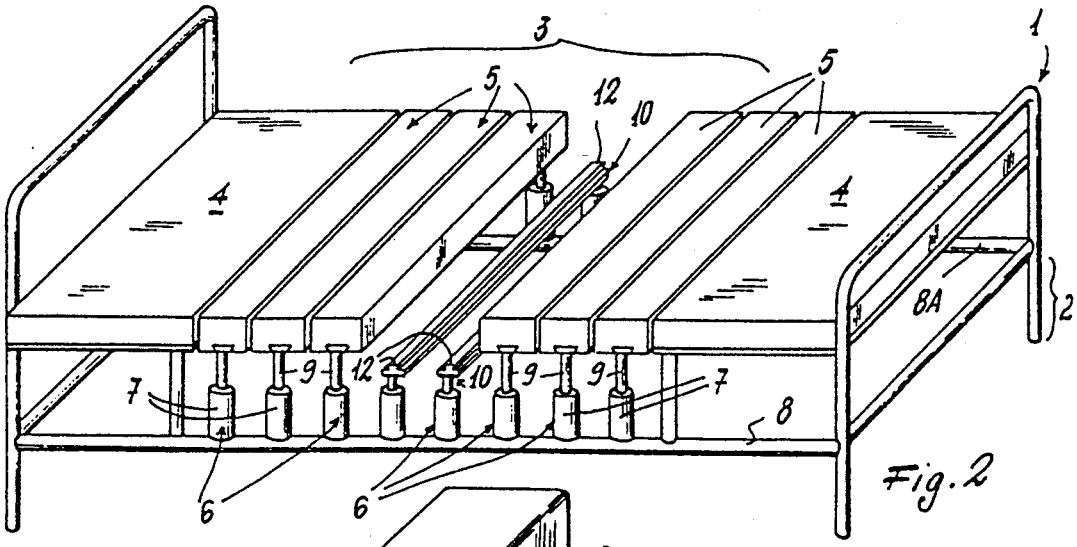
FIG. 2 is a perspective view of the bed of FIG. 1 with certain parts removed.
Figure 3:
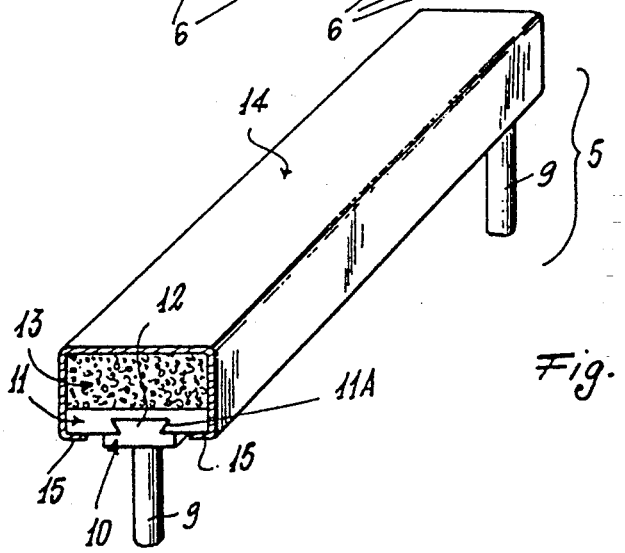
FIG. 3 is an enlarged perspective partly sectional view of part of the bed of FIG. 1.

In FIGS. 1 to 3 the bed is indicated overall by the reference numeral 1 and comprises a frame 2 and a resting surface 3. The resting surface 3 comprises two fixed ends 4 and, between these, elements 5 which are mobile vertically relative to the plane defined by the resting surface 3. These mobile elements 5 are arranged transversely and adjacent to each other along the resting surface 3. They are also mutually independent. These elements 5 are moved independently by hydraulic cylinder-piston units 6 each provided with a fixed part or cylinder 7 rigid with a cross-member 8, 8A of the frame 2, and a rod 9 mobile within said cylinder 7 under the pressure of a fluid.

The various cylinder-piston units 6 are arranged on parallel cross-members 8 and 8A of the bed 1 in facing pairs. In this manner the rods 9 of any two cylinder-piston units 6 which face each other on said two cross-members 8 and 8A support the opposing ends of load-bearing bars 10 which support the element 5. Said element 5 (see specifically FIG. 3) comprises a base part or base 11 which can be inserted, advantageously by sliding, onto the load-bearing bar 10. For this purpose there is provided in the base 11 a recess 11A in which a corresponding advantageously dovetail-shaped part (as shown in FIG. 3) of the bar 10 is housed and can slide.

On the base 11 of each element 5 there is secured a length of padding 13 for the element 5 and formed advantageously of sponge rubber, wool or other similar material. The padding 13 is covered by a piece 14 of fabric (known hereinafter as the bedsheet), the edges 15 of which are elasticized so that it fits properly around the padding 13, while at the same time it can be easily removed from padding when required.

The cylinder-piston units 6 (which can be replaced by other conventional mechanical or electromagnetic means for raising the elements 5) are connected to a hydraulic, pneumatic or hydropneumatic circuit, the pipes of which are shown schematically by dashed lines 20 in FIG. 1. Each cylinder-piston unit 6 or pair of cylinder-piston units 6 which face each other on the cross-members 8 and 8A can be operated independently of the remaining cylinder-piston units or pairs of cylinder-piston units 6. For this purpose, the pipes 20 of the hydraulic circuit or the like, which comprises known elements (pump, tank etc.) shown grouped together for simplicity within the block 21, are fitted with conventional means (valves or solenoid valves) for feeding and discharging the fluid of said circuit to and from the cylinder-piston units 6. The means 6, called hereinafter simply valves, are controlled advantageously by a microprocessor circuit or more simply microprocessor 23, which, on the basis of the data provided by the user and a preset program, causes the fluid under pressure to be fed to or discharged from the cylinder-piston units 6.

It will now be assumed that the bed 1 is to be used, and more particularly that the elements 5 positioned in the center of the resting surface 3 (substantially those removed in FIG. 2) are to be lowered.

To this end, the user by way of a conventional interface commands the microprocessor 23, which opens the valves 22 corresponding to the pairs of cylinder-piston units 6 supporting those elements 5. The valves enable the fluid, such as air, which is present in the fixed parts 7 (or cylinders) of said cylinder-piston units to be vented, these enabling the rods 9 to retract into said cylinders. In this manner the load-bearing bars 10 descend, thus lowering the required elements 5.

Figure 4:
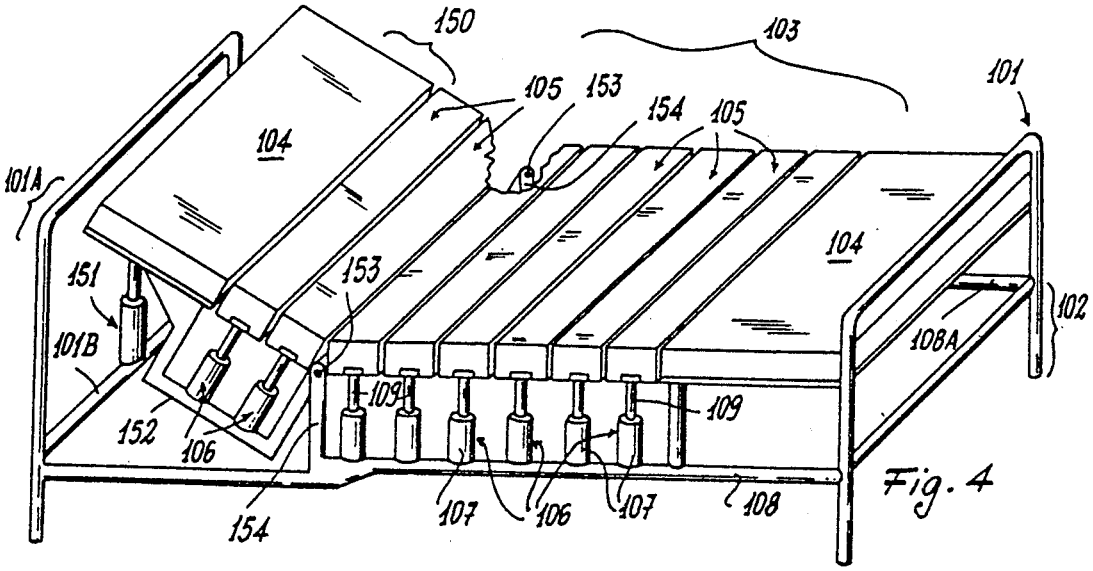
FIG. 4 is a perspective view of a modification of the bed of FIG. 1.

Using the microprocessor 23 it is also possible to program the movements of the individual elements, both in terms of their sequence and in terms of the times at which they are to move. It is also possible, preferably with the element 5 lowered, to remove it by its base 11, together with the padding 13, for example in order to change the bed-sheet 14. This is done by withdrawing said base 11 (and the padding 13) from the part 12 of the load-bearing bar 10, then removing the bedsheet from said padding 13 and replacing it with another. Because of the elastic edges 15 with which the bedsheet is provided, this operation is very quick and simple. Having done this, the base 11 (together with the padding 13) is reinserted on the bar 10 and the element 5 is returned to the level of the other elements forming the resting surface 3. In this manner all the fabric pieces associated with the various mobile elements 5 (and also those associated with the fixed parts 4 which are advantageously removably associated with support bars, not shown) can be replaced without having to get the patient to leave the bed or move from his lying position. Finally, it should be noted that the hydraulic pipes 20 and valves 22 are advantageously positioned within the cross-members 8, 8A of the frame 2 of the bed 1, the elements of the hydraulic circuit 21 being located at the foot of the bed, and the connections between the valves 22 and microprocessor 23 being also located within the cross-members 8 and 8A, which microprocessor 23 can be located on a table (not shown) associated with the frame 2 of the bed 1. FIG. 4 shows a first modification of the bed described with reference to FIGS. 1 to 3. In FIG. 4, elements corresponding to those described and represented in FIGS. 1, 2 and 3 are indicated by the same reference numerals plus 100.

In the FIG. 4, at least one end portion 150 of the resting surface 103 comprising at least one of the fixed parts 104 is inclinable on said resting surface 103. In FIG. 4, for simplicity that portion 150 close to the headpiece 101A of the bed 100 is shown to be inclinable, said portion 150 comprising not only the fixed part 104 but also mobile elements 105 (two in FIG. 4). The portion 150 is again moved by at least one cylinder-piston unit 151 connected to a cross-member 101B of the bed headpiece 101A. The cylinder-piston units 106 relative to the elements 105 of the inclinable portion 150 are carried by supports 152 secured at one end to the fixed part 104 and hinged at the other end at 153 to arms 154 extending from the cross-members 108 and 108A. The use of the illustrated bed 101 is analogous to that of the bed shown in FIGS. 1 and 2, and will therefore not be further described.

Figure 5:
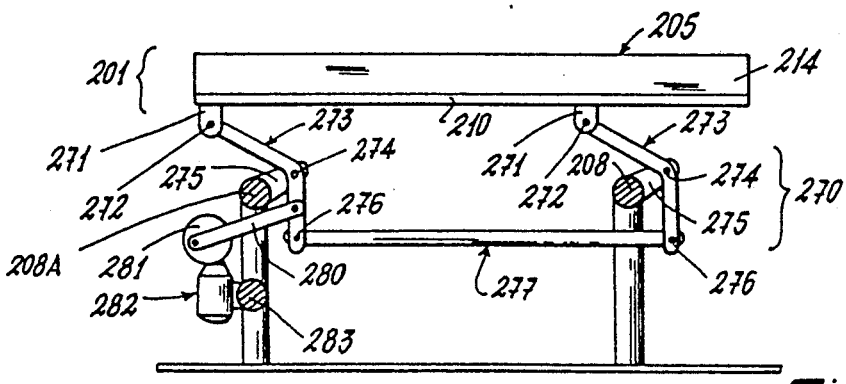
FIG. 5 is a cross-section through a further modification of the bed of FIG. 1 but with certain parts removed.
Figure 6:
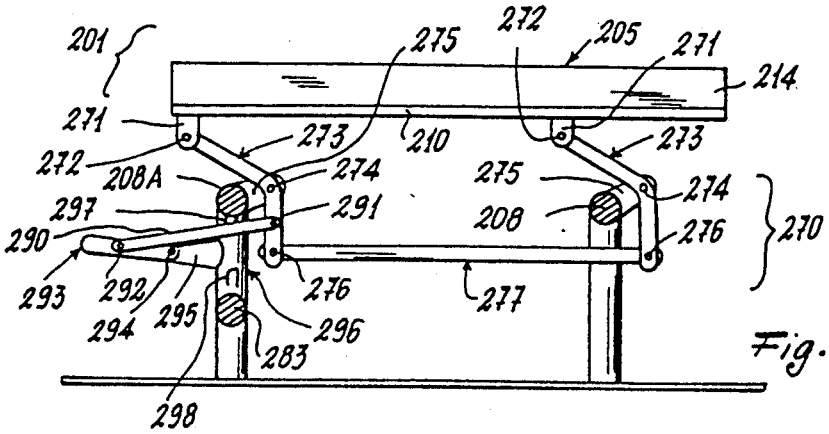
FIG. 6 is a view similar to that of FIG. 5 but of a further modification of the bed of FIG. 1.

FIGS. 5 and 6 show a further embodiment of the bed of the preceding figures. In these figures, parts equal to those described with reference to FIGS. 1 to 3 are indicated by the same reference numerals plus 200.

In FIGS. 5 and 6 each element 205 is moved by an articulated parallelogram system 270.

In particular, the support bar 210 for each mobile element 205 forms one of the sides of the articulated parallelogram. This bar comprises projections, to which a further two sides 273 of the parallelogram 270 are hinged, at 272. The sides 273 are hinged at 274 to projections 275 extending from the cross-members 208 and 208A of the bed 201 in positions corresponding with each mobile element 205, and are hinged at 276 to the other side 277 of the articulated parallelogram. In the embodiment shown in FIG. 5, on one of said two sides 273 there acts a connecting rod 280 operated by a crank 281 rotated by an electric motor 282, for example of the direct current and advantageously stepping type. This motor is fixed to a cross-member 283 parallel to the (upper) cross-member 208A and located between this latter and the floor on which the bed 201 rests.

In contrast, in FIG. 6 each articulated parallelogram 270 is moved manually. For this purpose, on one of the two sides 273 of each articulated parallelogram there acts an arm 290 hinged at 291 to said side 273 and at 292 to a lever 293. This lever is hinged at 294 to a projection 295 rigid with a bar 296 arranged to be perpendicular to the cross-members 208A and 283 and supported by these cross-members. Finally, two projections 297 and 298 are provided on the bar 296 to act as limit stops for the movement of the arm 290.

To use the bed 201 shown in FIG. 5, the motor 282 is operated in any known manner to rotate the crank 281. This latter, via the connecting rod 280, deforms the articulated parallelogram 270 and thus lowers the mobile element 205 rigid with it.

Again in this case the electric motor or motors 282 associated with each mobile element 205 can be programmed. This is done, as described with respect to FIGS. 1 and 2, by a microprocessor (not shown in FIG. 5) located for example to the side of the bed 201. The bed 201 shown in FIG. 6 is used by a user rotating the lever 293, with consequent movement of the arm 290 from a position in which it abuts against the projection 297 to a different position in which it abuts against the projection 298. In this manner, the articulated parallelogram 270 is made to move, with consequent lowering of the mobile element 205.

It should be noted that, with the described embodiment illustrated in FIG. 6, each element 5 can assume only two positions, defined by the cooperation between the arm 290 and the projections 297 and 298, whereas each element 5 or 105 of the beds shown in FIGS. 1, 2, 4 and 5 can assume any position between that of a completely raised element 5 (or 105) and that of a completely lowered element 5 (or 105).

Summarizing, in the bed according to the present invention the resting surface consists of various mutually independent adjacent elements connected to the bed frame in an articulated manner, i.e. such that each of said elements can be lowered, i.e. displaced from the resting plane, and can be raised to be returned to the level of said resting plane. In addition, each element can be easily removed. The individual elements can be lowered and raised either manually or automatically by suitable mechanical means, and can be programmed in their sequence and times of movement.

Certain elements which it is considered not necessary to move, such as those corresponding to the head and/or feet, can be fixed to the frame in a non-articulated manner.

When a person lies on said bed, the temporary intended lowering of one or more elements, and their consequent separation from those parts of the body subject to the formation of bed sores, obviates any possibility of formation of such sores since prolonged compression on limited parts of the body is prevented. In addition, if the various mobile elements are alternately raised and lowered in a programmed manner, a form of massage is obtained which favors blood circulation and thus improves the general state of the patient.

In addition to this, by removing suitable mobile elements, it is possible to expose and therefore make accessible that part of the patient's body which requires specific localized treatment, without actually moving the patient. Furthermore, the patient can be put in a position to comfortably satisfy his physiological needs by lowering and/or removing suitable elements.

What is claimed is:

1. A bed, in particular for a person obliged to spend long periods in a lying position, comprising a frame a plurality of mutually independent adjacent elements which, when each element is in a corresponding upper position to said adjacent elements, form a keyboard-shaped substantially planar resting surface for said person, and which elements are vertically mobile independently of each other and downwardly from the resting surface whereby each of said plurality of mobile elements can by downward movement totally detach itself from contact with said person lying on said resting surface, said bed comprising respective means for moving each of said mobile elements, each of said respective means for moving each of said mobile elements comprising an articulated parallelogram structure connected to a movement generating means for moving said articulated parallelogram structure, said movement generating means being immovable with respect to the bed frame said bed frame including cross-members, each of said articulated parallelogram structures being connected to and supported by said cross-members via projections hinged to two sides of each of said articulated parallelogram structures.

2. A bed as claimed in claim 1, wherein the mobile elements are removable.

3. A bed as claimed in claim 1, wherein each of the plurality of mobile elements comprises a base part which can be secured to a load-bearing bar subjected to the action of said means for moving said elements, and comprises, affixed to said base part there being a length of padding, said padding being covered by a respective piece of fabric having elasticized edges to facilitate covering of each said transverse elements by a respective piece of fabric.

4. A bed as claimed in claim 3, wherein the base part comprises a recess into which a projecting part of the load-bearing bar can be slidingly inserted.

5. A bed as claimed in claim 4, wherein said projecting part is dovetail-shaped.

6. A bed as claimed in claim 1, wherein said movement generating means comprise electric motors, each motor being connected to and immovable with respect to a second cross-member of said bed frame which is parallel to one of the cross-members of the frame of the bed and is located between said cross-member and the floor on which the bed rests, and a connecting rod operated by a crank rotated by said motor, said connecting rod connected to one of said two sides of each articulated parallelogram.

7. A bed as claimed in claim 6, wherein said electric motors are d.c. motors.

8. A bed as claimed in claim 7, wherein said d.c. motors are step motors.

9. A bed as claimed in claim 1, characterised in that the means for producing the movement of each articulated parallelogram are levers, each of said levers being hinged to an arm secured to one of the sides of the articulated parallelogram, each of said levers being also hinged to a projecting part of a bar located between one of the cross-members and a lower cross-member, on said bar there being provided abutments to act as limit stops for the movement of the arm secured to said lever.

10. A bed as claimed in claim 1, wherein the means for producing the movement of the mobile elements are connected to a microprocessor circuit.

11. A bed as claimed in claim 1, wherein the resting surface comprises at least one inclinable end portion, said end portion comprising a fixed part of the resting surface, the movement of said end part being produced by gears or hydraulic means, and said bed further comprising a plurality of supports for carrying the means for moving one or more of said mobile elements connected with said end portion.

12. A bed as claimed in claim 1, wherein said elements are transversely positioned across said frame.

* * * * *